United States Patent [19]

Anderson

[11] Patent Number: 4,621,620

[45] Date of Patent: Nov. 11, 1986

[54] HUMAN LIMB MANIPULATION DEVICE

[76] Inventor: Gene Anderson, 832 3rd Ave., Apt. 104, Excelsior, Minn. 55331

[21] Appl. No.: 600,502

[22] Filed: Apr. 16, 1984

[51] Int. Cl.[4] ..... A61H 1/02

[52] U.S. Cl. ..... 128/25 R

[58] Field of Search ..... 128/25 R, 25 B, 24 R, 128/80 R, 80 G; 272/129, 130

[56] References Cited

U.S. PATENT DOCUMENTS 2,079,594 5/1937 Clem ..... 128/25 R 4,235,437 11/1980 Ruis et al. ..... 272/129

*Primary Examiner*—Robert A. Hafer

*Assistant Examiner*—Kathleen D'Arrigo

*Attorney, Agent, or Firm*—Williamson, Bains, Moore & Hansen

[57] ABSTRACT

An active human limb manipulation device utilizes a frame to which a carriage is slidably mounted for vertical movement. A sub-carriage is movably mounted to the carriage for horizontal movement and carries the limb of a patient along a predetermined path. Both carriage and sub-carriage are powered by a pair of rodless cylinders which are controlled by a computer control system which simulates normal walking movement so as to strengthen and stretch the limbs of a patient who otherwise lacks the strength and muscle tone associated with normal limb movement. The cylinders have yokes which are fixed to the carriage and sub-carriage and retained in position on the cylinders by a magnetic attraction. When the patient's resistance to movement reaches a predetermined level, the yoke will break the magnetic bonds with the cylinder piston so as to avoid overstressing the limbs of the patient. The yoke may be supplied with an electromagnet so that the magnetic attraction can be closely controlled.

33 Claims, 9 Drawing Figures

HUMAN LIMB MANIPULATION DEVICE

BACKGROUND OF THE INVENTION

As a result of illness, accident or other bodily injury, thousands of otherwise fully ambulatory people become bedridden or otherwise wholly or partially immobilized for varying time periods. During these times of prolonged physical inactivity, the arms and legs of the patient can progressively weaken and become atrophied, and recovery of normal limb movements and strength can be a slow and difficult process. While such difficulties exist for both arms and legs, the process of strengthening the legs to a point where they will carry the full body weight and returning them to a condition suitable for walking can be particularly slow and discouraging for a recovering patient. While the problems associated with returning the bedridden or immobilized patient to a fully ambulatory condition have been long recognized, the medical equipment industry has failed to develop any workable, safe device which can actively manipulate the legs of the patient so as to simulate normal motion such as walking, and most medical rehabilitation efforts have been directed to conventional calisthenics and physical thereapy.

Little attention has been directed toward the production of a powered, controllable device which can actively manipulate the limbs of a patient so as to simulate normal limb movement. For example, it is highly desirable to provide a device which can manipulate the legs of a patient in vertical and horizontal directions to simulate normal walking movement. Such a device would be highly beneficial for increasing the leg strength and degree of leg movement of patients who are virtually unable to move their legs in any substantial continuous fashion.

It is known to construct various passive splint devices such as those shown in U.S. Pat. Nos. 4,323,060, 3,066,322 and 3,661,150 for retaining the legs in various predetermined positions. Similarly, there are numerous passive traction appliances which retain the legs but permit limited amounts of movement such as those shown in U.S. Pat. Nos. 3,878,842, 3,616,795, 3,800,787 and 3,135,257. All of the devices shown in these patents are intended to retain the limbs in predetermined largely fixed positions and are passive devices. None show an active device which is capable of physically manipulating the limbs along predetermined paths so as to simulate walking or other normal limb activity.

For a human limb manipulation device to be effective, it must be adaptable to the many physical variables encountered among those who will use it. For example, there are numerous semi-mobile patients whose limbs can be moved only through very limited linear or angular displacements without generating intense discomfort or actual tissue damage. The device must be adaptable to closely control the degree of both linear and angular displacement of the limb in order to be safely usable with such patients.

With other patients, the limbs may be marginally controllable by the patient and sometimes will undergo spastic or convulsive movement which may be sharply opposed to the direction of movement of the device. In such situations, the device must be capable of releasing the limb before tender tissues or ligaments are damaged.

Accordingly, while the device must be capable of fairly precise movements and responsive to limb resistance, the mechanism must still be able to move the limb through a wide range of different positions and movements and at varying speeds suitable to the patient's development. It is helpful if the device can be used both while the patient is bedridden and while in an upright position. To permit use of the device in a standard hospital bed, the device must be relatively compact, lightweight and easily movable by a minimum of personnel. It is desirable that the device be capable of manipulating either a single leg or both legs simultaneously so as to simulate truly normal walking movement.

The invention described herein provides a device which meets these needs and can be utilized to return thousands of otherwise bedridden and immobilized patients to an ambulatory condition. It can be used with a bedridden patient at intervals during a prolonged hospital stay to prevent the atrophy and deterioration which can otherwise result in a loss of walking ability.

SUMMARY OF THE INVENTION

The invention relates to the field of treatment devices for those who are bedridden or immobilized and provides an active, powered, safe device for manipulating the limbs, and particularly the legs, of a patient through walking movement or other appropriate exercise to strengthen, stretch and rehabilitate injured or atrophied limbs.

The invention utilizes a rigid frame which may be supported on a patient's bed or elsewhere and which utilizes a carriage which is moved upward and downward by a hydraulic rodless cylinder. A sub-carriage is mounted to the carriage for back and forth horizontal movement controlled by a second rodless cylinder. A patient's leg is supported and retained by webbing on the sub-carriage. The specific movements of the cylinders are controlled by a microprocessor and include conventional walking movement, resulting in the device being able to move a leg through the same vertical and horizontal movements associated with walking. This movement, which can be accomplished even with the patient in a supine position, serves to provide necessary stretching and working of the leg muscles to strengthen and tone the muscles for walking or to help maintain existing muscle tone and strength in an otherwise immobilized patient. The device may be used in tandem with a second identical unit so as to provide coordinated walking movements of both left and right legs.

Rodless, hydraulic cylinders with magnetic yoke retention are used as the power transducers for the device and permit the device to be unexpectedly compact, usable even on a hospital bed and so lightweight as to be easily movable by a single operator.

The rodless cylinders utilized with the invention include a break-away feature wherein the cylinder includes a movable piston within a sleeve and a moving yoke or follower outside the sleeve. In a first embodiment, the yoke engages the piston by magnetic attraction between permanent magnets within the piston and on the yoke. The magnetic attraction can be overcome by excessive patient resistance, and accordingly, the yoke will separate from the piston when the patient's limb undergoes excessive spastic resistance or other movement in opposition to the cylinder. This provides a safety feature which assures that powered movement by the cylinder will not injure or tear the tissues of the patient.

In an alternative embodiment, the cylinder is provided with a core which is of ferrous material but is not a magnet. The yoke is then provided with an electromagnet which can engage the core with a predetermined force of attraction determined by regulating magnitude of the current flow through the electromagnet. This arrangement permits close control over the breakaway parameters and permits the device to be closely adapted to the varying levels of strength encountered in different patients.

The device utilizes an upright column to which the carriage is slidably mounted. The carriage has a pair of spaced, cantilever arms which extend toward the patient and which are biased to rollably retain the sub-carriage on guideways within the arms.

Each of the rodless cylinders is connected to a hydraulic system which utilizes a pair of electrically actuated directional control valves. A microprocessor sends control signals to each of the directional valves to move the cylinders in back and forth directions.

A first position sensing device is mounted on the carriage and the frame to generate an electrical position signal which is fed to the microprocessor and indicates the relative location of the carriage along the frame. A second position sensing device is mounted on and adjacent the carriage to indicate the position of the sub-carriage relative to the carriage. This second sending device supplies a second electrical position signal to the microprocessor. Accordingly, the microprocessor is supplied with data indicating the position of the carriage and sub-carriage and additionally the rate at which the two are moving in horizontal and vertical directions. Using such data and a prearranged program, the microprocessor can actuate the two rodless cylinders to move the limb along a variety of paths and to simulate walking or other movements.

The hydraulic system utilizes a flow speed control valve connected with the first and second cylinders to control the speed at which the carriage and sub-carriage move. The flow speed control valve is controlled electrically by the microprocessor so as to adjust the speed to the needs of specific patients.

A pressure sensor is located in the hydraulic line connected with the cylinder which controls movement of the sub-carriage toward and away from the patient. The pressure sensor measures the force of resistance generated by the patient's limb and in response generates an electrical signal which is delivered to the microprocessor and is representative of the magnitude of the resistance force. The microprocessor then monitors the pressure signal and when such signal exceeds some predetermined maximum magnitude, shuts down the hydraulic system or disengages the cylinder yoke from the piston so as to protect the patient from excessive manipulatory forces. With the microprocessor closely monitoring the fluid pressure within the system, it is possible to vary the pressure with individual patients so as to increase or decrease the forces applied to the limb and make them more suitable to the individual therapy needs of the patient.

By proper programming of the microprocessor, any desired exercise movement can be generated by the device so as to move the limb, to control the speed of movement, to stretch and hold the limb for a predetermined time, and the like. Such program can be permanently recorded and repeated at will with a specific program being created for each patient.

These and other objects and advantages of the invention will appear more fully from the following description made in conjunction with the accompanying drawings wherein like reference characters refer to the same or similar parts throughout the several views.

DESCRIPTION OF THE PREFERRED EMBODIMENTS

Figures 1, 9:
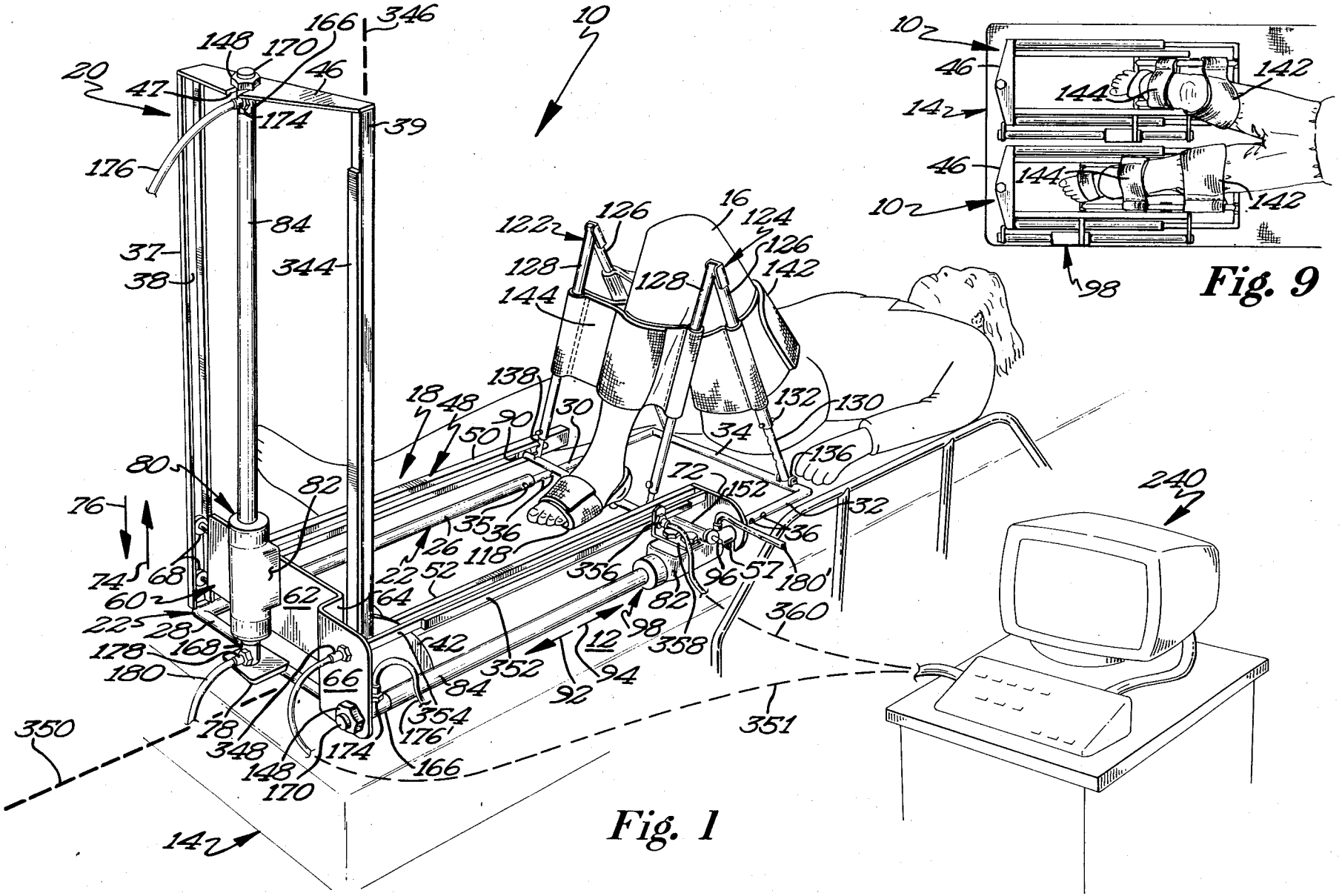
FIG. 1 is a perspective view of a human limb manipulation device embodying the invention and shown in operation on a hospital bed to stretch and strengthen the leg of a patient.
FIG. 9 is a top representational view of a pair of human limb manipulation devices arranged to work in tandem to manipulate both left and right legs of a patient to fully simulate walking movement.

Referring now to FIG. 1, a human limb manipulation device 10, embodying the invention, is shown positioned on the surface 12 of a hospital bed 14 to manipulate a leg 16 of a patient.

As best shown in FIGS. 1-4, the device 10 utilizes a rigid frame 18 preferably formed of stainless steel alloy, the frame including upright column 20 and a generally horizontal, preferably rectangular base 22 supported on the surface 12 of the bed.

The base 22 includes left and right horizontal spaced apart, parallel base bars 24 and 26, respectively, which are rigidly interconnected by front base crossbar 28 which intersects the front ends of bars 24 and 26 at right angles. The base bars 24 and 26 are preferably of circular cross section with hollow interiors which slidably, telescopically receive left and right base extension bars 32 and 30, respectively, which are interconnected by transversely extending rear base crossbar 34. The rear crossbar 34 is preferably welded between sliding extension bars 30 and 32, the bars 30, 32 and 34 forming a slidable section which moves in and out of the hollow interior of base bars 24 and 26 to permit the length of the base 22 to be adjusted to the needs of individual patients. A detent or clamping system 35 passes through each of the base bars 24 and 26 adjacent the free ends of those bars to engage any of a plurality of spaced adjusting apertures 36 in sliding bars 32 and 30 and clamps the sliding bars to the fixed bars 24 and 26 to adjust the overall length of the base to the patient's needs. The fixed base bars 24 and 26, the sliding base bars 30 and 32, and the transverse crossbars 28 and 34 collectively comprise one type of base 22 usable with the invention. It should be understood that while a specific type of base has been disclosed herein, other bases which provide stable support for the device 10 may be substituted and are within the purview of the invention.

The upright column 20 of the frame 18 extends upwardly at a substantially right angle from base 22 and includes a pair of spaced, generally parallel, rigid posts 37 and 39 having guideways 38 and 40, respectively. The posts 37 and 39 are welded to the base bars 24 and 26, respectively, and are reinforced by first and second batten plates 44 and 42 (FIGS. 3 and 4), respectively, which are welded between the fixed base bars and the upright posts. An upper cross brace 46 extends between and is rigidly fixed to the tops of posts 37 and 39 and has a slot 47 which helps support a first rodless cylinder 80, described further hereafter.

Referring again to FIGS. 1 and 2, the device 10 is provided with a vertically movable carriage 48, which utilizes first and second, spaced apart, generally parallel cantilever arms 50 and 52, having generally U-shaped cross sections which define slotted guideways 51 and 53, respectively, into which roller bearings 90 are received, as will be described hereafter.

The arms 50 and 52 are welded to reinforcing flanges 54 and 56, respectively, the flanges being welded to and extending forwardly from carriage housing plate 60. The carriage housing plate 60 includes a rigid flat section 62 which extends between posts 37 and 39 and abuts spacer 58. The housing plate 60 further includes an integral angled segment 64 which extends transversely to section 62 to clear the upright post 39 and subsequently angles through a further right angle to define a forward mounting bracket 66 which is generally parallel to section 62 and to which one end of a second rodless cylinder is mounted.

The flat section 62 has a pair of outwardly extending roller bearings 68 on axles 59, the bearings 68 extending and rollably engaging the guideway 38 of post 37. Similarly, a second pair of roller bearings 70 extends from the opposite end of axles 59 and into the guideway 40 of post 39. A mounting bracket 72 extends generally perpendicularly, outwardly from the free end of cantilever arm 52 and has a slot 57 which receives an end of the second rodless cylinder 98, described further hereafter.

Figures 3, 4:
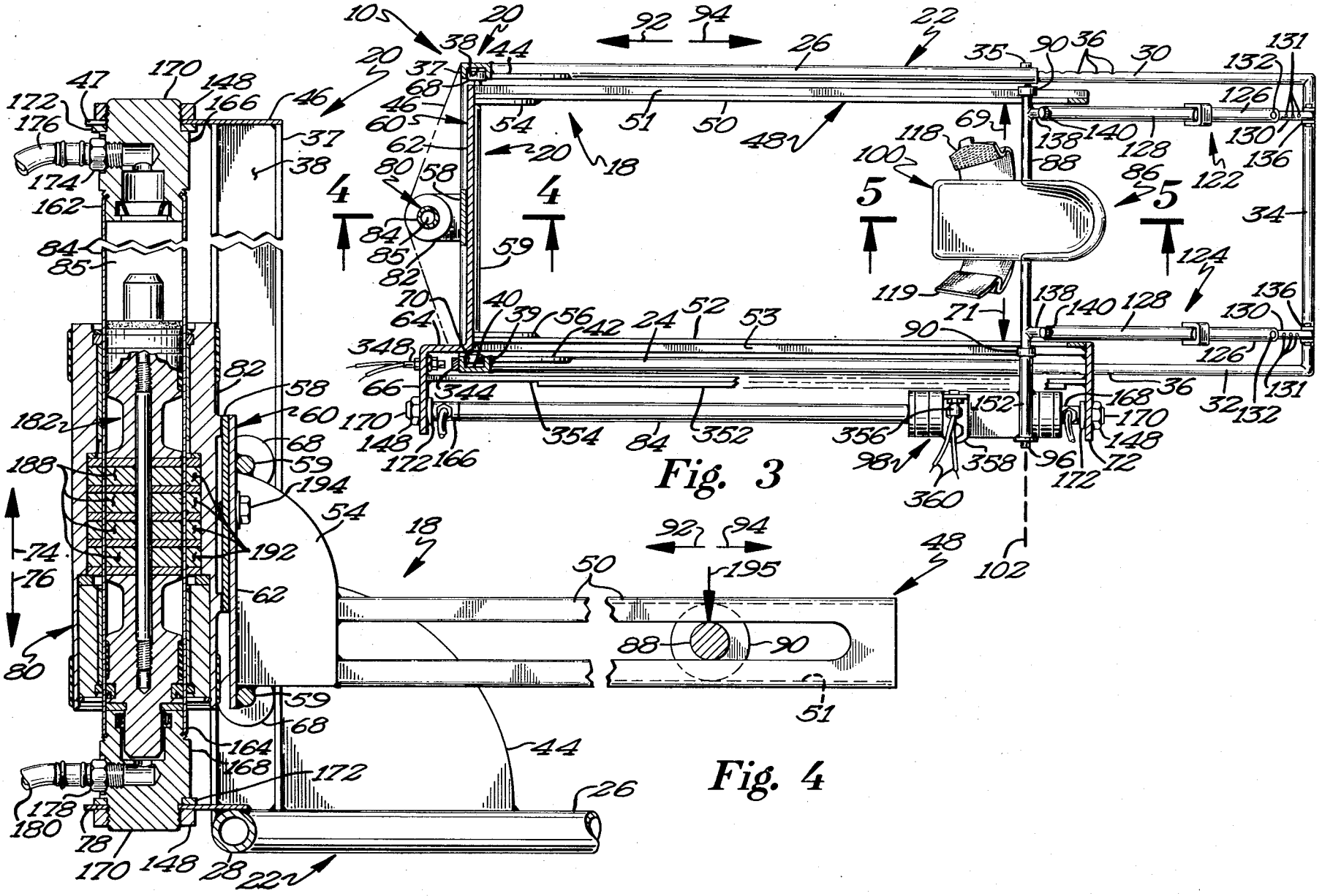
FIG. 3 is a cross sectional top elevation view of the device of FIG. 1 taken in the direction of cutting plane 3—3 of FIG. 2.
FIG. 4 is a partial cross sectional side elevation view of the device of FIG. 1 taken in the direction of cutting plane 4—4 of FIG. 3 and showing the configuration of a first type of rodless cylinder usable with the invention.

Referring next to FIG. 3, the arms 50 and 52 are biased to exert outward transverse forces in directions 69 and 71, respectively, so that roller bearings 90 are urged into the guideways 51 and 53. This biasing arrangement cooperates with the bearings 90 and the bearing axle 88 to assure smooth rolling action of the sub-carriage 86, described hereafter, along the arms 50 and 52.

Accordingly, the cantilever ams 50 and 52, carriage axles 59, housing plate 60, the roller bearings 68 and 70 and mounting bracket 72 collectively comprise a movable carriage 48 which is freely slidable relative to column 20 in directions 74 and 76 parallel to a first axis 346.

A rigid base plate 78 is welded to the crossbar 28 and has an aperture through which the threaded lower end 170 of rodless cylinder 80 extends, a nut 148 securing the end to the plate 78. The upper end 170 of the cylinder 80 is anchored in the slot 47 of cross brace 46 by a nut 148 which threadably engages the end 170. A movable yoke or follower member 82 moves upwardly and downwardly in directions 74 and 76, respectively, along cylinder sleeve 84 and is securely connected with carriage housing plate 62.

Referring now to FIGS. 1 and 3, a sub-carriage 86 is slidably mounted between the cantilever arms 50 and 52 and utilizes a transverse axle 88 which passes through the slotted arms and carries roller bearings 90 which are contained within the guideways 51 and 53 of biased arms 50 and 52 and which roll in directions 92 and 94. The axle 88 includes an axle extension 96 which extends outwardly from arm 52 and is rotatably received in socket 152 which is fixed to the second rodless cylinder 98.

Figure 5:
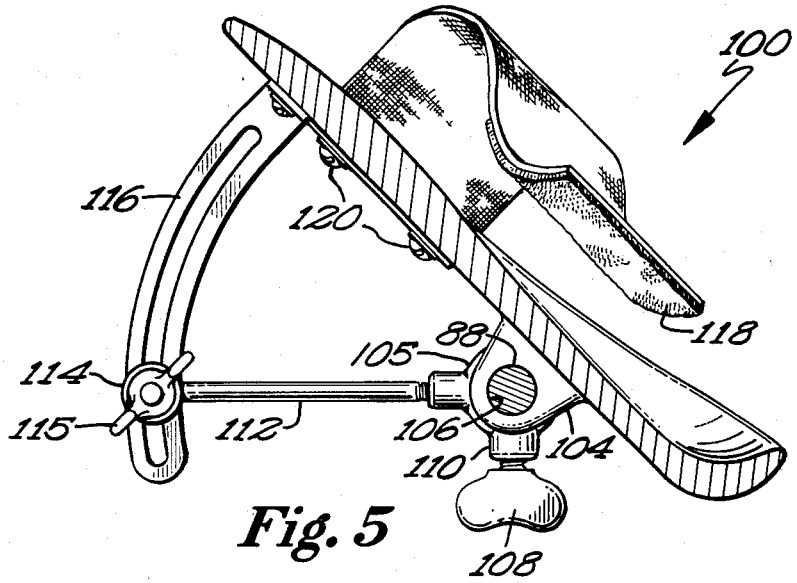
FIG. 5 is a cross sectional side elevation view of a foot retaining and supporting device used with the device of FIG. 1 and taken in the direction of cutting plane 5—5 of FIG. 3.

A foot stirrup 100 is swingably mounted for movement about the central axis 102 of axle 88 as best shown in FIGS. 3 and 5. The stirrup has a downwardly extending clevis 104 into which a swivel member 105 is inserted, the swivel having a transverse aperture through which the axle 88 is rotatably received. A wing screw 108 is threaded into a boss 110 on member 105 and may be selectively tightened against the axle 88 to lock the member 105 to the axle 88. When the wing screw 108 is loosened, swivel member 105 is freely rotatable about the axle 88 and the stirrup 100 moves freely about axle 88. The member 105 carries a forwardly extending rod 112 which terminates in a clamp 114 and wing nut 115. The clamp 114, when loosened, permits selective sliding movement of the rod along arcuate adjusting member 116. Accordingly, the stirrup 100 may be securely tightened to the axle 88 by tightening wing screw 108, and with screw 108 tight, the stirrup can still undergo some further angular adjustment through the arc defined by member 116. Member 116 thus permits most adjustments needed by the patient's feet. In some instances, however, it is desirable to swing the stirrup and member 105 about the axle 88 to a different position, and this can be accomplished by loosening wing screw 108 and rotating the stirrup as desired. Velcro mounting bands 118 and 119 are attached to the stirrup by screws 120 and effectively retain the foot of the patient during operation of the device 10.

A pair of sub-carriage linkages 122 and 124 extend between axle 88 and crossbar 34. Since the linkages are substantially identical to one another, only the linkage 122 will be described in detail.

The linkage 122 comprises femoral linkage 126 and tibial linkage 128 which are pivotally mounted to one another. The femoral linkage 126 is formed of a generally circular, hollow rod into which an adjustable extension 130 is telescopically slidable. A series of apertures 131 in the extension 130 engage with detent 132 of rod 126 to permit the extension to adjust the distance between linkage 128 and bar 34 to adapt the length of the femoral linkage to different length legs. The lower end of extension 130 is swingably mounted to clevis 136 which is fixed to the crossbar 34.

A tibial extension 138 is welded to transverse axle member 88 and slidably, telescopioally received within the hollow interior of tibial linkage 128. The extension is provided with apertures 131 which are selectively engaged by detent 140 to adjust the overall length of the femoral linkage and extension to the length of the lower leg of a patient.

An upper leg retention and support webbing 142 extends between the femoral linkages 126 and releasably, adjustably encircles the upper leg of the patient.

Similarly, a lower leg support and retention webbing 144 encircles and supports the lower leg of the user and is retained between the tibial linkages 128. Both straps are preferably secured by Velcro fasteners.

The webbing 142 and 144 and stirrup 100 and its associated straps 118 and 119 collectively comprise a means for supporting and retaining the limb so as to carry the limb with the sub-carriage 86 during movement of the sub-carriage and to assure that the leg bends normally at the knee during operation of the device 10. Accordingly, the axle 88, bearings 90, stirrup 100, linkages 122 and 124, along with webbing 142 and 144, collectively comprise one type of sub-carriage 86 suitable for use with the invention to support and move the leg of a patient.

The second cylinder 98 has a threaded end 170 secured to the forward mounting bracket 66 by threaded nut 148. Similarly, the remaining threaded end 170 of the cylinder 98 is slipped into a slot in the bracket 72 and secured therein with nut 148 to complete the attachment of elongated sleeve 84 between brackets 66 and 72 of carriage 48. Because axle 88 is rotatably retained within socket 152, and the socket is fixed to the yoke 82 of cylinder 98, as the axle 88 moves in directions 92 and 94 the linkages 122 and 124 swing the axle 88 through a slight arc within socket 152.

Figure 2:
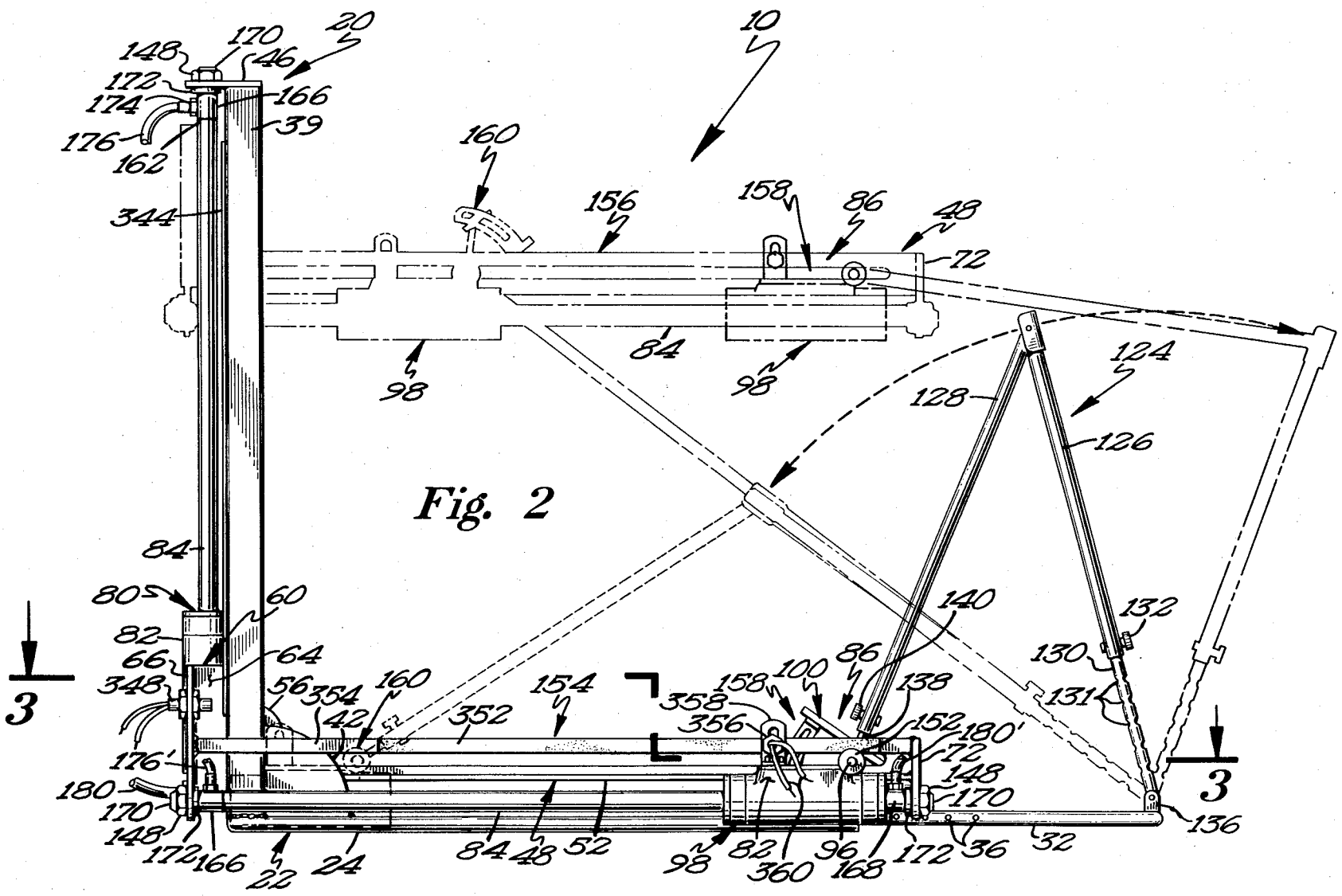
FIG. 2 is a side elevation view of the device shown in FIG. 1 wherein alternative positions of the moving carriage and sub-carriage are shown in phantom.

As best shown in FIG. 2, the carriage 48 may be raised and lowered by rodless cylinder 80 between the lowest position 154 and highest position 156. The sub-carriage 86 is freely movably by rodless cylinder 98 between its rearward positions 158 nearest rear crossbar 34 and its forward positions 160 adjacent column 20. It should be understood that the carriage and sub-carriage can occupy a continuous range of positions between these extremes, as described hereafter.

Since the rodless cylinders 80 and 98 which serve as transducers for the device 10 are substantially identical, only the cylinder 80, best shown in FIG. 4, will be described in detail. The cylinder 80 is similar to that shown in U.S. Pat. No. 3,779,401 to George Carrol issued Dec. 18, 1973 for Pneumatic Device For Moving Articles.

The cylinder 80 is a hydraulic cylinder and utilizes an elongated hollow sleeve or barrel 84 of nonferrous material having a cylindrical chamber 85 therein. The cylinder found most advantageous for the embodiment 10 has a sleeve with an outer diameter of one inch and a length of approximately eighteen inches. The first and second ends 162 and 164, respectively, of the barrel are tightly closed by end caps 166 and 168, respectively. Each end cap has a threaded segment 170 which carries an annular gasket 172. The segment 170 is slipped into notch 47 of cross brace 46 with the gasket 172 below the brace 46, and a threaded nut 148 is tightened onto the segment to secure the upper end of the cylinder 80 to the brace 46. Similarly, as best shown in FIG. 4, threaded nut 148 secures the end segment 170 of lower cap 168 to the base plate 78 with a gasket 172 being interposed between plate 78 and the cap 168.

Adjacent the first end 162, a first fluid inlet port 174 passes through the cap 166 to communicate with the chamber 85 to permit flow of pressurized hydraulic fluid in and out of the chamber. The inlet port 174 is coupled to hydraulic hose 176 which extends to a hydraulic system described hereafter in FIG. 8. While it is preferred to utilize a hydraulic system for operation of the cylinder, it should be understood that a pneumatic cylinder system is also usable and is within the purview of the invention.

Figure 8:
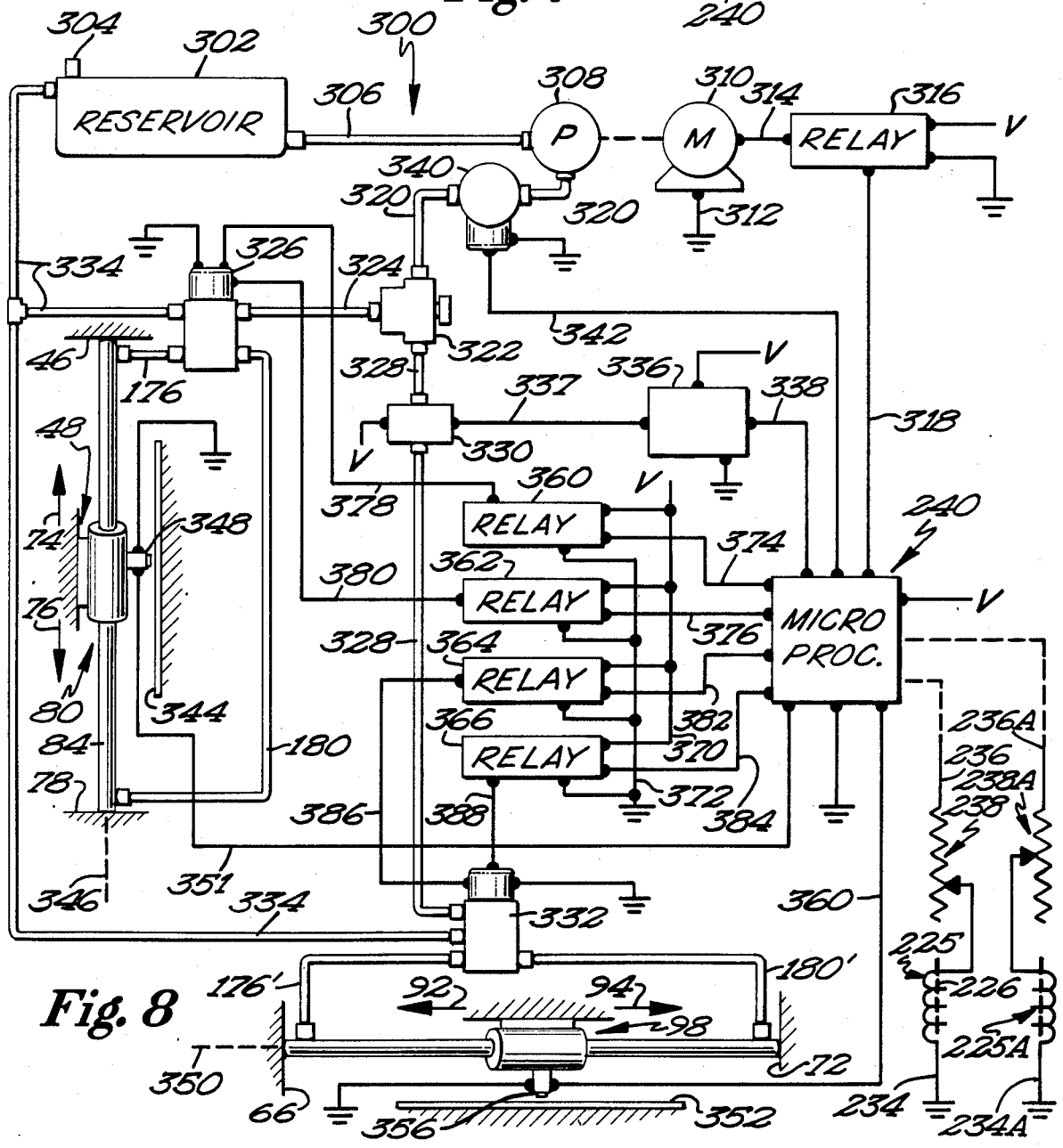
FIG. 8 is a control system plan drawing showing the hydraulic and electrical components used to actuate and control the human limb manipulation device.

A second fluid inlet port 178 passes through second end cap 168 to communicate with the chamber 85 and is coupled to hydraulic hose 180 which extends to the hydraulic system of FIG. 8.

Positioned within the chamber 85 is a movable piston member 182 which sealably engages the inner wall of the barrel 84 and is slidable in directions 184 and 186 in response to fluid being injected through ports 178 and 174, respectively. The piston member 182 is provided with a permanent magnet positioned centrally therealong and defined by a plurality of annular discrete permanent magnet units 188. Since the barrel 84 is formed of nonferrous material, the piston 182 moves freely along the barrel without magnetic interaction therebetween.

A yoke member or follower member 82 has a generally annular configuration and closely surrounds the outer surface of the barrel 84 for sliding movement along the barrel. The yoke 82 is supplied with a permanent magnet consisting of a multiplicity of annular, permanent magnet units 192, which are spaced to permit direct confrontation between the bands comprising the magnet 192 and the bands comprising magnet 188 in the piston member 182. Accordingly, as one slides the yoke 82 along the barrel 84, the permanent magnet 192 of the yoke will align with and magnetically attract and engage the permanent magnet 188 of the piston member and directly confront the piston member through the barrel as shown in FIG. 4. Accordingly, as the piston member 182 moves within the barrel, the yoke or follower 82 moves with it external to the barrel.

The yoke 82 is attached to the carriage housing plate 60 and spacer plate 58 by bolts 194 which are threadably received in apertures in the yoke 82. Accordingly, as the yoke 82 moves in direction 74 and 76, the carriage 48 is carried with the yoke.

While the rodless cylinder 80 has been shown as being formed with permanent magnets in the piston member and in the core member, it is possible to utilize in its place an alternative cylinder having a permanent magnet in either the piston member or the follower member, but not both. When such alternative is used, the remaining member need be supplied only with an element of ferrous material which will be attracted by the permanent magnet. With such an arrangement, the magnetic force attracting the two members toward one another will be lessened somewhat from that existing with two permanent magnets, but in many situations the lessened force is adequate for the needs of the device 10.

In the event that the patient generates forces in opposition to the direction of movement of the cylinder 80, as for example when the cylinder is moving in upward direction 74 and the patient reacts sharply to such movement and produces a downward opposition force 195 (FIG. 4) in direction 76, such force 195 is applied to the carriage 48 by roller bearings 90. If the force 195 is sufficient to overcome the magnetic attraction between the permanent magnets of the yoke and the follower, the yoke 82 will be urged downwardly in direction 76 and will separate from the magnetic engagement with the piston member 82. Accordingly, this breakaway feature assures that the limb of a patient will not be subjected to a force in excess of the magnetic attraction between yoke and follower. While the breakaway feature has been described in conjunction with cylinder 80, it should be understood that the cylinder 98 has the same breakaway capability to deal with opposition forces in directions 92 and 94.

Figure 7:
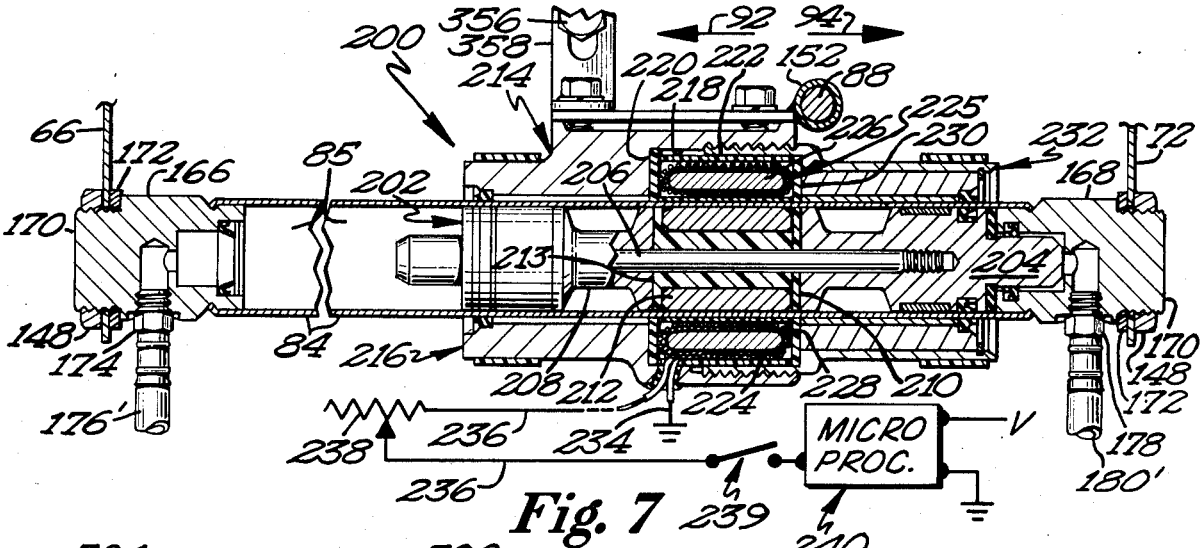
FIG. 7 is a cross sectional side elevation view of an alternative embodiment of a new rodless cylinder usable with the device and for the moving of other loads.

Referring next to FIG. 7, an improved rodless cylinder 200 is shown embodying the invention. The embodiment 200 is similar to the cylinder 80, previously described, but is provided with an electromagnet. The current flow to the magnet may be turned off and on and the magnitude of the current varied so as to closely control the attraction between the yoke member and the piston member. For purposes of illustration, the cylinder 200 is shown as replacing the cylinder 98 of FIGS. 1–4 but can also replace the cylinder 80.

The alternative embodiment 200 utilizes a barrel 84 and interior chamber 85 substantially identical to those described for cylinders 80 and 98. End caps 166 and 168 close the ends of the barrel, and fluid is supplied to and removed from the barrel through inlet ports 174 and 178 which are coupled to hydraulic lines 176' and 180', respectively. Other components identical to those of cylinder 80 are numbered the same as those shown in the embodiment 80 of FIG. 4.

The piston member 202 of cylinder 200 is similar to that used with the embodiment 80 except that the permanent magnet associated with the embodiment 80 has been removed and replaced by a soft iron core which is readily attracted by an electromagnet in the yoke.

The piston member 202 has a first section 204 which engages a threaded rod 206 which extends longitudinally from second section 208 of the piston. Sandwiched between the first and second sections is an insulative gasket 210 and an insulative spool 213 which contain an annular iron slug 212 which is positioned closely adjacent the inner wall of barrel 84 so as to be highly attracted by the electromagnet which will be described hereafter.

The rod 206 of piston section 208 passes through a central aperture in the spool 213 and is threaded into piston section 204 to tightly sandwich the spool, slug and gasket therebetween. Appropriate seals are provided between the piston member 202 and the barrel 84 to assure smooth fluid-tight operation as the piston 202 moves in directions 92 and 94 in response to oil entering the cylinder from inlet port 178 and 174, respectively.

The cylinder 200 is provided with a follower or yoke member 214 which is formed with a first case segment 216 which is provided with an annular chamber 218 at one end. At the inner end of chamber 218 is an insulative washer 220. An insulative sleeve 222 is positioned at the outer edge of the chamber 218 and insulates the chamber wall from coils 224 of electromagnet 225 which has a soft iron core 226. An additional insulative sleeve 228 separates the electromagnetic coils from the barrel 84 and insulates therebetween. A second insulative washer 230 further isolates the electromagnet 225. A second case segment 232 is threadably received into the first case segment 216 and effectively contains the electromagnet 225 within the chamber 218.

Electromagnet wires 234 and 236 extend to ground and to manually adjustable potentiometer 238, respectively, A switch means 239 may be used for manual control. The potentiometer is supplied with current from the microprocessor 240 which is connected to power source V and turns the current to the electromagnet on or off in response to the program under which the microprocessor 240 is operating.

One type of hydraulic and electrical control system 300 usable with the device 10 is shown in FIG. 8. A hydraulic fluid reservoir 302 containing oil or other appropriate hydraulic fluid is filled through inlet 304, and the reservoir is connected through hydraulic line 306 to hydraulic pump 308. The pump 308 is mechanically coupled to a DC current motor 310 which is preferably operational on twelve volt power. The motor has one of its electrical leads 312 connected to ground and the remaining lead 314 to electric relay unit 316.

The relay 316 is a commercially available relay whose function is to pass electrical power from power source V through the relay to the motor 310 when the relay is closed by a control signal flowing from the microprocessor 240 along lead 318. Accordingly, the microprocessor, by energizing the relay 316, can close the relay 316 to deliver electrical power from power source V to the motor 310. Similarly, when the microprocessor ceases to deliver a control signal along line 318 to the relay, the relay opens, discontinuing current flow from power source V to the motor 310 and turning the motor off.

A hydraulic fluid flow speed control valve 340 is connected in hydraulic line 320 between the pump 308 and a flow divider 322 to control the speed of the hydraulic fluid flow from the pump to the cylinders so as to control the speed at which the pistons move along the cylinders 80 and 98. The flow speed control valve is selected to be electrically controllable by means of an input signal from microprocessor 240 delivered along lead 342.

Hydraulic line 320 extends to the flow divider valve 322 which may be manually adjustable by an operator. With the device 10, it has been found effective to set the flow divider 322 such that approximately twice the amount of flow is directed to the cylinder 98 as to the cylinder 80.

The flow divider valve 322 is connected by hydraulic line 324 to an electrically actuated directional control valve 326 and has a second hydraulic line 328 which is connected through pressure sensor 330 to a second electrically actuated direction control valve 332. The valve 326 has one outlet connected with hydraulic line 176 which terminates at the upper end of cylinder 80. Valve 326 has a second hydraulic line 180 terminating at the lower end of cylinder 80. Similarly, valve 332 has hydraulic lines 176' and 180' terminating at the left and right ends, respectively, of hydraulic cylinder 98. During movement of hydraulic fluid within the shown system, pressure is supplied by the pump 308, and excess fluid from the solenoid valves 326 and 332 is fed back to the reservoir 302 along hydraulic return line 334.

Because control valves 326 and 332 are identical, only the operation and mechanism of control valve 326 will be described. These valves are commercially available units well known to the art and are constructed to respond to a first electrical power input from the relay 360 by moving the valve to permit hydraulic fluid to flow along hydraulic line 176 into the upper end of the cylinder 80 while hydraulic fluid leaves the lower end of cylinder 80, flowing along hydraulic line 180 back to the control valve. Similarly, when a second electrical power input is received by the control valve in lead 380, the process is reversed with the valve shifting position to permit fluid flow along hydraulic line 180 from the valve and into the lower end of cylinder 80 with hydraulic fluid leaving the cylinder 80 and flowing along line 176 back to the valve. By such fluid movement, the piston of the cylinder 80 is moved upwardly or downwardly as required for proper operation. It should be noted that the valve 326 functions to inject hydraulic fluid into line 176 or 180 but not into both simultaneously.

Pressure sensor 330 is positioned in hydraulic line 328 to determine the pressure of the hydraulic fluid entering the control valve 332. Because valve 332 services hydraulic cylinder 98 which is associated with movement of the sub-carriage toward and away from the patient's torso, it is helpful to sense the pressure produced by the resistance force which the patient is applying to the sub-carriage. By measuring such pressure with sensor 330, it is possible to generate an electrical pressure signal which will indicate the patient's reaction to the device. The pressure sensor 330 is connected to a power source V and with a signal generator 336 which is powered by the voltage source V. The generator 336 may be any suitable unit which can receive a low power signal along lead 337 to measure the pressure detected by the sensor 330 and in response to the pressure detected, generates an appropriate analog or digital signal which it delivers to microprocessor 240 along lead 338.

Referring now to FIGS. 1, 2 and 8, a first position sensing strip 344 is attached to post 39 by an appropriate adhesive and extends along upright axis 346. The strip 344 is formed of a flexible rubber-like material into which are formed a series of discrete, individual magnets which are positioned at regularly spaced intervals of one fourth inch. A first magnetic sensor 348 is attached to the bracket 66 of the carriage and passes through an aperture therein to closely confront the sensing strip 344. The sensor 348 will typically contain a coil which when passed in close proximity to any discrete magnet on the strip 344 will have a voltage induced therein. This induced voltage is delivered to the microprocessor along electrical line 351. If desired, the sensor 348 may include circuitry to generate a specific type of digital or analogue position signal suitable for the microprocessor. The microprocessor counts the number of position signals received from the sensor 348, and since a signal is generated each time a discrete magnet of the strip 344 is passed by the sensor, the microprocessor can determine the location of the carriage along axis 346 within approximately one fourth inch. The microprocessor will be initially programmed to define some specific position along the sensor strip 344 as an origin, and thereafter the incoming signals from the sensor 348 will advise the microprocessor of the displacement of the carriage relative to that origin. Accordingly, the position sensor 348 and position sensing strip 344 constitute a first position sensing device positioned on the column and the carriage to generate a first electrical position signal in response to detection of each discrete magnet on the strip 344.

A second position sensing device is utilized to determine the position of the sub-carriage 86 along a second axis 350 which is substantially perpendicular to axis 346. The second position sensing device utilizes a position sensing strip 352 identical to the strip 344 and provided with the plurality of regularly spaced discrete magnets therein. The strip 353 is fixed by adhesive to a flat metal rod 354 which is welded between brackets 66 and 72. A second sensor 356, substantially identical to 348, is carried by sensor bracket 358, which is attached to the yoke of cylinder 98. The sensor 356 directly confronts magnetic strip 352 and detects each individual discrete magnet therealong as the sensor moves along the strip in response to movement of the cylinder 98. As individual magnets are detected, the sensor 356 generates a second electrical position signal and delivers it to the microprocessor along wire 360. Accordingly, the magnetic sensing strip 352 and the sensor 356 collectively comprise a second position sensing device which generates a second position signal representative of the location of the sub-carriage along the second axis 350 and relative to a predetermined reference point or origin along strip 352. This reference point can be any point on the strip 352 selected by the operator as an origin. It should be noted that the microprocessor, by determining the time intervals between magnetic pulses received from the sensors 348 and 356 can also determine the speeds at which the carriage and sub-carriage move.

While the position sensing device has been shown herein as comprising a magnetic system, it should be understood that other sensing devices such as an infrared beam and photocell may be utilized and are within the purview of the invention.

Referring again to FIG. 8, relays 360, 362, 364 and 366 are all individually connected to a voltage source V through common line 370 and share a common ground 372. These relays are substantially identical and each is connected to the microprocessor 240 to be energized by the microprocessor. When any of the described relays 360–366 is energized by the microprocessor, the relay closes an internal switch which permits current flow from the power source V to pass through the relay and to be applied to a control valve 326 or 332.

Relays 360 and 362 are energized by leads 374 and 376, respectively, which are connected to the microprocessor. When relay 360 is energized by the microprocessor, its internal switch closes and current flows from power source V through the relay and along lead 378 to valve 326 causing the control valve to change its position so as to permit hydraulic fluid flow out of the control valve and through hydraulic line 176 to move the piston and yoke of cylinder 80 in a downward direction 76. Similarly, when relay 360 is turned off and relay 362 is energized by a control signal from the microprocessor along line 376, the internal switch of relay 362 moves to a closed position and current flows from the power source V along wire 380 to energize the control valve 326 to open the valve so as to have hydraulic fluid move from the valve along hydraulic line 180 and into the cylinder 80 to cause the piston and yoke to move upwardly in direction 74.

It should be understood that relay 360 and 362 are never in an "on" condition simultaneously and that only one such relay will be actuated at a time. Accordingly, the control valve 326 will be delivering fluid flow to either hydraulic line 176 or 180, but never both simultaneously. When neither relay 360 or 362 is energized, the control valve 326 remains in a neutral position wherein the piston and yoke remain substantially stationary along the barrel 84.

Solenoid control relays 364 and 366 are connected by wires 382 and 384, respectively, to the microprocessor 240 to allow the microprocessor to selectively actuate the relays. When actuated, the relays 364 and 366 move their internal switches to a closed position and conduct current from power source V outwardly from the relay along wires 386 and 388, respectively, to control valve 332. It should be understood that relays 364 and 366 will not be operated simultaneously and that one or the other will be energizing the control valve 332 when it is necessary to move the cylinder 98. As relay 364 closes, the solenoid valve 332 is actuated to allow hydraulic fluid flow along line 176' to move yoke 82 in direction 94. When relay 366 is actuated by the microprocessor, it in turn energizes control valve 332 to permit hydraulic fluid flow along line 180' to move the yoke 82 in direction 92. When neither relay 364 or 366 is energized, the yoke and piston associated with cylinder 98 remain stationary.

In the description of the computerized control system of FIG. 8 which has been thus far made, it has been presumed that the magnetic coupling between yoke and piston of the cylinders 80 and 98 has been obtained by use of one or more permanent magnets and that electromagnets 225 have not been utilized. When electromagnets are utilized as the means of attraction, such electromagnetic cylinders may be substituted for either or both cylinders 80 and 98.

To utilize the electromagnet coupling arrangements shown in FIG. 7, a cylinder 200 is substituted for the cylinders 80 and 98. The electromagnet 225 associated with the first or vertical cylinder, which may be mounted in place of cylinder 80, is connected in series with potentiometer 238 and wire 236 to the microprocessor 240. The electromagnet 225 has its remaining line 234 connected to ground. With such connection arrangement, it is presumed that the microprocessor has sufficient power from source V to adequately energize the electromagnet 225 to supply the desired level of attraction between piston and yoke of the cylinder 200.

Similarly, the second electromagnet type cylinder would be utilized in place of cylinder 98 and is designated in the schematic of FIG. 8 as having an electromagnet 225A connected to ground 234A and energized through a potentiometer 238A which is connected by wire 236A to the microprocessor which supplied the power to energize the electromagnet. When the current level to the electromagnet 225 or 225A requires increase or decrease, an operator may manually adjust potentiometer 238 or 238A as required. It is also contemplated that the microprocessor may be programmed to serve as a switch means to turn off the current to either or both electromagnets so as to cause immediate release between piston and yoke under appropriate conditions. Such conditions would include a sensing of high pressure by the sensor 330 of the type caused by an involuntary muscle reaction of the patient.

In operation, the limb manipulation device 10 is positioned on a surface 12 such as the bed 14 of a patient, and the patient's leg 16 is secured within the upper and lower leg webbings 142 and 144 with the patient's foot being secured in stirrup 100 by cooperating straps 118 and 119. By appropriate telescoping of the extensions 130 and 138 relative to femoral and tibial linkages 126 and 128, respectively, linkages 122 and 124 are adjusted in length to the femoral and tibial portions of the patient's leg. With proper adjustment, the pivotal hinges between tibial and femoral linkages should be substantially in line with the knee joint of the patient.

A qualified therapist or physician next determines the extent of stretching or bending of the limb which is suitable for the patient and also determines the speed and time duration of the movement to be prescribed. Based on these determinations, the operator programs the microprocessor 240. Among the information to be supplied is the origin or point along axis 350 at which the sub-carriage should begin its movement and the maximum displacement in directions 92 and 94 which the sub-carriage 86 should travel before stopping and beginning its return. Similarly, the operator determines the maximum displacement as measured along axis 346 through which the carriage 48 should be raised to provide adequate stretching and strengthening of the leg 16. This displacement is noted, as is a suitable origin on axis 346 and both are programmed into the microprocessor 240.

If the electromagnet type cylinder 200 of FIG. 7 is utilized with the cylinders, the operator will also adjust the potentiometers 238 and 238A so that the attractive force to be generated by the electromagnets 225 and 225A are limited to levels safe for the patient. If the patient generates resistance in excess of these defined magnetic forces, the yoke 214 of the cylinder 200 will break its magnetic engagement with the piston 202 to thereby assure that the patient's limb is not harmed.

With the above parameters programmed into the microprocessor, the system can be actuated. In accord with a program adapted to the patient as described above, the microprocessor will initially energize relays 362 and 366 to produce movements of carriage 48 in direction 74 and sub-carriage 86 in direction 92.

To move the carriage 48 in direction 74, the microprocessor energizes relay 362 which in turn energizes solenoid directional control valve 326 so as to produce fluid flow along line 180 and into the barrel 84, pushing the piston in direction 74 and causing the existing magnetic attraction between the piston 182 and yoke 82 to move the yoke upwardly. The yoke 82, which is attached to the carriage 48, lifts the carriage in direction 74 proportion to movement of the piston 182. If, for any reason, the patient's leg convulses or excessively opposes the movement of device 10 to the point where continued movement by either piston could cause tissue damage, such opposition will break the magnetic coupling force between piston 182 and yoke 82, and consequently the yoke will disengage from the piston and slip. The patient is thus protected from any excessive forces which might otherwise harm his legs.

As the carriage slides upwardly in direction 74, the sensor 348 moves along the sensing strip 344 and as it passes each discrete magnet, a current is generated in the sensor 348 and a first electrical position signal is sent to the microprocessor 240. The microprocessor then counts such signals to continually keep track of the location of the carriage as measured from its starting point. When the carriage has moved in direction 74 a predetermined distance which had been earlier defined by the operator, the microprocessor opens relay 360 and energizes relay 362. Energizing relay 362 causes the electrical directional control valve 326 to discontinue further fluid flow along line 180 and institutes fluid flow into line 176 which in turn causes the piston 182 of cylinder 80 to begin to move downwardly in direction 76. Naturally, as the carriage moves downwardly, the sensor 348 signals the number of magnets passed in its new direction of movement and provides such information to the microprocessor. The microprocessor continues the movement in direction 76 until a predetermined number of magnets has been counted and then authorizes a reversal.

Simultaneously with the actuation of the vertically oriented cylinder 80, the microprocessor will also be operating the horizontal cylinder 98. The microprocessor 240 energizes relay 366 which actuates directional control valve 332 to produce fluid flow along hydraulic line 180' to move the yoke of cylinder 98 in direction 92 a predetermined distance determined by the program provided by the operator.

As the yoke of the cylinder 98 moves, it carries the sub-carriage 86 therealong and the axle 88 and its roller bearings 90 roll along the guideways of cantilever arms 50 and 52 in direction 92. The outward biasing forces 69 and 71 exerted by arms 50 and 52 against the roller bearings 90 keep the rollers moving smoothly along the guideway and reduces unwanted arm vibration.

As the sub-carriage 86 moves along the cantilever arms, the sensor 356 moves with the yoke of cylinder 98, senses the field of each individual discrete magnet in the strip 352 and generates a second electrical position signal each time a magnet is detected. These position signals are fed to the microprocessor along wire 360 and are counted to determine the displacement of the sub-carriage 86 from the initial starting point or origin. When the sub-carriage has moved forwardly in direction 92 a predetermined distance, the microprocessor turns off relay 366 and energizes relay 364. As the relay 364 closes, the directional control valve 332 stops any further fluid flow in line 180' from valve 332 to cylinder 98 and begins to move the hydraulic fluid along line 176' toward the cylinder 98 thereby moving piston and the yoke in direction 94. As the sub-carriage 86 moves in direction 94, the sensor 356 counts the number of magnets passed in its reverse movement and supplies position signals to the microprocessor to allow the microprocessor to know the precise location of the sub-carriage.

It should be understood that both horizontal and vertical movements of the sub-carriage 86 and carriage 48 will occur simultaneously according to the probram of the microprocessor. Typically, it has been found desirable to program the microprocessor to generate movement which would be closely simulative of the path a human leg would follow during normal walking.

Figure 6:
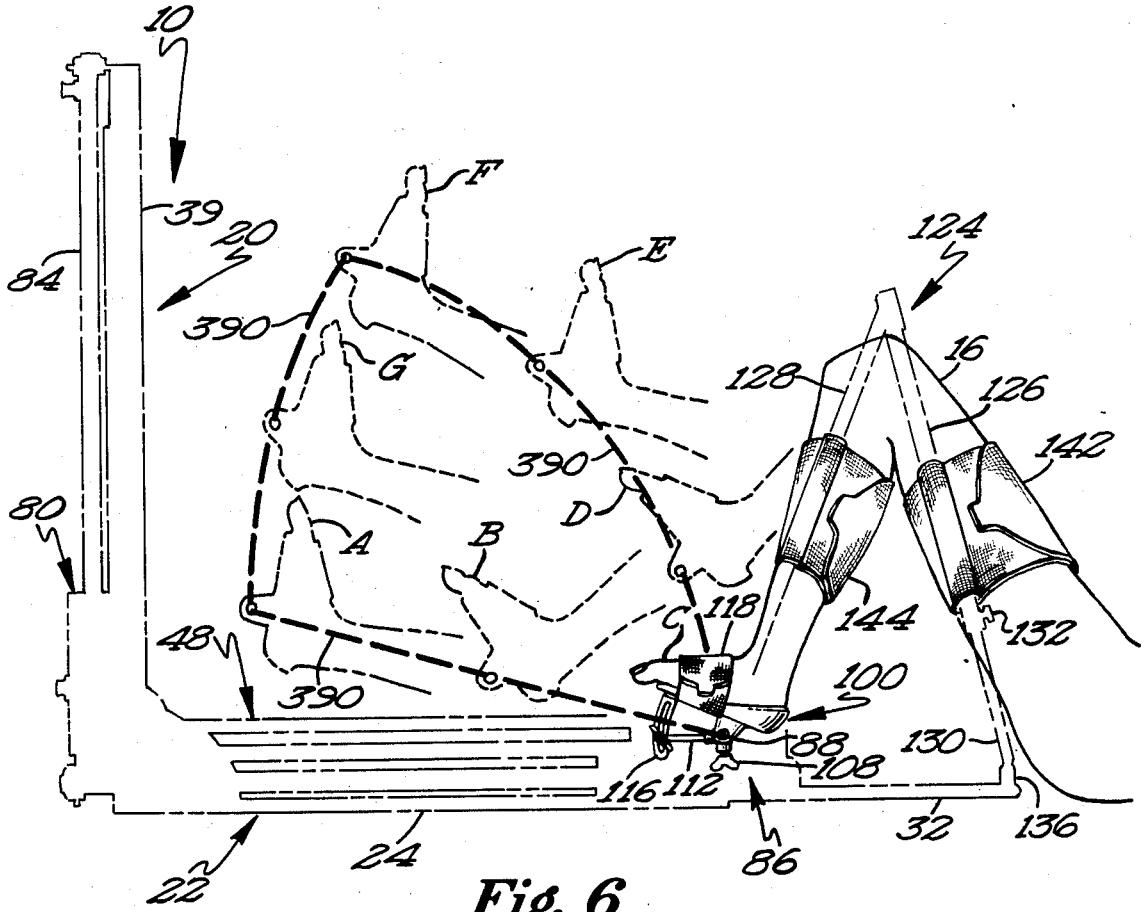
FIG. 6 is a side view taken partially in phantom showing the device of FIG. 1 moving a patient's leg along a path and showing the successive leg positions as walking movement is simulated by the device.

Referring now to FIG. 6, such a simulated walking path 390 is shown wherein the leg might start at an initial position indicated by A, and subsequently move along a path 390 whereby the leg moves from position A to B to C and onward through D, E, F and G, returning to position A. This walking movement of the leg can be repeated any number of times desired by the operator.

During movement of the leg along the path 390, the stirrup 100 can be set to rigidly retain the foot of the user in a predetermined position relative to axle 88, causing the various muscles and tissues of the leg to stretch to predetermined known degrees. Alternatively, the wing screw 108 may be loosened to permit the stirrup to pivot freely on the axle 88 to thereby decrease the amount of stretching and manipulation of the ankle. If any special position settings of the stirrup are required, the stirrup can be oriented on the axle 88 in any determined position and locked thereto by wing screw 108 and the stirrup then adjusted by means of adjustment strip 116 and wing nut 114.

It should be understood that while a device 10 has been disclosed herein which is suitable for the manipulation of a single leg, it is within the purview of the invention to utilize a pair of devices 10 in tandem such as shown in FIG. 9. There, the left and right legs of a patient are retained and supported in the tandem devices with both legs being manipulated alternately through a walking pattern. It will be understood by those skilled in the art that the microprocessor 240 can be programmed to simultaneously actuate both devices 10 with one leg moving forwardly at a time and thus simulating normal walking movement.

The invention may be utilized to not only move along a simulated walking path 390, but can be used to simply move the limb in a given direction and hold the limb in a stretching orientation for some predetermined time interval before returning it to a starting position. This process can be conducted with one or both legs simultaneously. It is also within the scope of the invention to vary the speed at which the manipulatory movement is conducted, with such speed increases being made possible by the flow speed control valve. As the valve is opened increasingly, the speed of the cylinders 80 and 98 will increase and consequently the movement of the leg can be increased in speed.

It is contemplated that the microprocessor can be utilized to generate a specific individual program for each patient wherein the program can contain a specific series of exercises which the machine will initiate with such patient. The program can be modified to count the number of exercises included in a given day and even maintain a continual case history of the physical therapy provided to the individual patient.

Accordingly, it will be seen that the present invention provides a substantial advance in the art by providing a device which can manipulate and stretch the limbs of patients who were previously virtually unable to exercise and further can provide a continual program of physical therapy which will prevent limb degeneration and promote the development of strong, well-toned muscles.

While the present invention has been shown as being used with a patient in a supine position, it should be understood that the invention can be modified to function with a patient in a more upright sitting or standing position to provide the type of therapy described herein.

While the preferred embodiments of the present invention have been described, it should be understood that various changes, adaptions and modifications may be made therein without departing from the spirit of the invention and the scope of the appended claims.

What is claimed is:

1. A human limb manipulation device usable with a power source having electrical and fluidic energy supplies to stretch and strengthen the limb, comprising:

a rigid frame including a base;

a carriage movably mounted to said frame for back and forth movement parallel to a first axis;

a first transducer connectable to the power source and mounted between said frame and said carriage to selectively, reciprocatingly move said carriage relative to said frame and along said first axis;

a sub-carriage movably mounted to said carriage for back and forth movement parallel to a second axis oriented substantially perpendicular to said first axis;

a second transducer connectable to the power source and mounted between said carriage and said sub-carriage to selectively, reciprocatingly move said sub-carriage relative to said carriage along said second axis; and means on said sub-carriage for supporting and retaining the limb so as to carry the limb with said sub-carriage during movement of said sub-carriage to stretch and strengthen the limb during movement of said carriage and said sub-carriage along said first and second axes.

2. The human limb manipulation device of claim 1 wherein said first transducer includes a first rodless cylinder connectable to the fluidic energy supply of the power source, said first cylinder comprising:

a first rigid, elongated, hollow barrel of substantially nonferrous material having a first elongated chamber therein and first and second fluid inlet ports at first and second ends, respectively, of said first barrel;

a first piston within said first chamber mounted for movement between said first and second ends in response to fluidic energy movement through said first and second inlet ports, said first piston including an element of ferrous material;

a first yoke positioned outside and closely adjacent said first barrel and slidably mounted for movement therealong, said first yoke including a first electromagnet connectable with the electrical energy supply for energizing said first electromagnet to magnetically attract and retain said element of said first piston to cause said first yoke to move along the outside of said first barrel in response to movement of said first piston within said first chamber;

said first yoke of said first cylinder being connected to said carriage; and first switch means electrically connected with said first electromagnet and connectable with the electrical energy supply to selectively actuate and deactuate said first electromagnet to permit controlled disengagement between said first piston and said first yoke of said first cylinder.

3. The human limb manipulation device of claim 2 and further including first means electrically connectable to the electrical energy supply and electrically connected with said first electromagnet to vary the magnitude of current flow through said first electromagnet to thereby vary the force of retention between said first electromagnet and said element so said first yoke will break magnetic engagement with said first piston when a predetermined excess force component is applied by the limb to said first yoke in a direction parallel to said first axis.

4. The human limb manipulation device of claim 3 wherein said second transducer includes a second rodless cylinder connectable to a fluidic energy supply of said power source, said second cylinder comprising:

a second rigid, elongated, hollow barrel of substantially nonferrous material having an elongated second chamber therein and first and second fluid inlet ports at first and second ends, respectively, of said second barrel;

a second piston within said second chamber mounted for movement between said first and second ends of said second barrel in response to fluid energy movement through said first and second inlet ports of said second barrel, said second piston including an element of ferrous material;

a second yoke positioned outside and closely adjacent said second barrel and slidably mounted for movement therealong, said second yoke including a second electromagnet connectable with the electrical energy supply for energizing said second electromagnet to magnetically attract and retain said element of said second piston to cause said second yoke to move along the outside of said second barrel in response to movement of said second piston within said second chamber;

said second yoke of said second transducer being connected to said sub-carriage; and second switch means electrically connected with said second electromagnet and connectable with the electrical energy supply to selectively actuate and deactuate said second electromagnet to permit controlled disengagement between said second piston and said second yoke of said second cylinder.

5. The human limb manipulation device of claim 4 and further including second means electrically connectable to the electrical energy supply and electrically connected with said second electromagnet to selectively vary the magnitude of current flow through said second electromagnet to thereby vary the force of retention between said second yoke and said second piston so that said second yoke will break magnetic engagement with said second piston when a predetermined excess force is applied to said second yoke directed parallel to said second axis.

6. The human limb manipulation device of claim 2 and further including a hydraulic system connected with said first rodless cylinder and connectable to the fluidic energy supply to selectively actuate said first cylinder.

7. The human limb manipulation device of claim 1 wherein said frame includes a rigid column fixed to said base and extending upwardly from said base and parallel to said first axis.

8. The human limb manipulation device of claim 7 wherein said carriage is movably mounted to said column for vertical movement along said column,

9. The human limb manipulation device of claim 8 wherein said carriage includes a pair of spaced, substantially parallel, cantilever arms extending in a direction transverse to said column.

10. The human limb manipulation device of claim 9 wherein each said cantilever arm includes a guideway therealong, and said guideways of said arms movably receive said sub-carriage therein for movement along said guideways.

11. The human limb manipulation device of claim 10 wherein each of said guideways has a U-shaped cross section, said sub-carriage includes roller bearings, rollably received within each of said U-shaped guideways, and each of said cantilever arms are biased to exert forces in directions transverse to said second axis, urging said roller bearings into said U-shaped guideways.

12. The human limb manipulation device of claim 9 wherein said sub-carriage includes a pair of linkages, each said linkage being swingably connected with said frame and said linkages carrying webbing therebetween to support the limb.

13. The human limb manipulation device of claim 12 wherein each said linkage includes a femoral linkage and a tibial linkage with each said femoral linkage being swingably mounted to a said tibial linkage, said sub-carriage includes a transverse member extending between said arms, and said tibial linkages each having an end carried by said transverse member to allow said tibial and femoral linkages to cooperate with said webbing to bend and support the limb during movement of said carriage and sub-carriage.

14. The human limb manipulation device of claim 7 and further including a first position sensing device connectable to the power source to generate a first electrical position signal representative of the location of said carriage along said first axis and relative to a first reference point on said first axis.

15. The human limb manipulation device of claim 14 wherein said first position sensing device includes a first sensing strip positioned along said column, said strip including a plurality of regularly spaced, discrete magnets, and said position sensing device further including a first magnetic sensor movable with said carriage to scan said magnets of said first sensing strip as said carriage moves therealong to generate a first electrical position signal in response to detection of each discrete magnet on said first strip.

16. The human limb manipulation device of claim 14 and further including a second position sensing device to generate second electrical position signals representative of the location of said sub-carriage along said second axis and relative to a second reference point on said second axis.

17. The human limb manipulation device of claim 16 wherein said second position sensing device includes a second sensing strip positioned along said carriage and including a plurality of regularly spaced, discrete magnets, said sensing device further including a second magnetic sensor movable with said sub-carriage to scan said second sensing strip as said sub-carriage moves along said carriage, said second sensor generating a second electrical position signal in response to detection of each discrete magnet on said second strip.

18. The human limb manipulation device of claim 17 and further including a computerized control system electrically connected to said first and second position sensors to receive said first and second electrical position signals and in response thereto actuating said first and second cylinders to move said carriage and sub-carriage along a predetermined path to stretch and strengthen the limb.

19. The human limb manipulation device of claim 18 wherein said control system includes a computer and first and second fluidic, directional control valves fluidically connected to said first and second cylinders, respectively, each said valve being electrically connected to said computer so said computer may actuate said valves to energize said first and second cylinders and move said carriage and subcarriage along said predetermined path.

20. The human limb manipulation device of claim 19 wherein said control system includes a flow speed control valve fluidically connected with said first and second cylinders to permit control of the speed at which said cylinders move said carriage and said sub-carriage, said flow speed control valve being electrically connected with said computer to allow said computer to regulate the flow speed control valve.

21. The human limb manipulation device of claim 20 wherein said control system further includes a first fluid pressure sensor, said first pressure sensor being fluidically connected with one of said cylinders to measure fluid pressure in said ore of said cylinders with said first pressure sensor generating and delivering a first electrical pressure signal to said computer to indicate to said computer the load carried by said one of said cylinders.

22. The human limb manipulation device of claim 1 wherein said first transducer includes means for interrupting power movement of said carriage in response to a predetermined force of resistance being applied to said first transducer as a result of resistance from the limb.

23. The human limb manipulation device of claim 1 wherein said second transducer includes means for interrupting powered movement of said sub-carriage in response to a predetermined force of resistance being applied to said second transducer as a result of resistance from the limb.

24. The human limb manipulation device of claim 1 wherein said first transducer includes breakaway means to terminate movement of said carriage when a predetermined excess force is applied to said transducer by said carriage, thereby avoiding damaging movement to a human limb which is too stiff for manipulation.

25. The human limb manipulation device of claim 1 wherein the power source includes a source of pressurized fluid and wherein said first transducer includes a rodless cylinder, said rodless cylinder comprising:

a rigid, elongated hollow barrel of non-ferrous material connected between said frame and said carriage and having first and second ends, said barrel having a first fluid inlet port at said first end and a second fluid inlet port at said second end of said barrel with each of said ports being fluidically connectable to the source of pressurized fluid;

a piston member within said hollow barrel mounted for movement between said first and second ends of said barrel in response to fluid movement into and out of said first and second inlet ports, said piston member including an element of ferrous material;

a follower member including ferrous material therein, said follower member being located outside said barrel, closely adjacent thereto and mounted for movement along and parallel to said barrel;

one of said members including a magnet for engaging the other of said members to cause a magnetic attraction force between said follower member and said piston member to cause said members to move together along said barrel; and said follower member being connected to said carriage so that carriage and follower member can disengage said piston member if excessive loading is applied to said carriage so as to exceed the magnetic attraction force between said follower member and said piston member.

26. A human limb manipulation device connectable to a power source and usable on a surface to move a human limb along a predetermined path to stretch and strengthen the limb comprising:

a rigid frame supportable on the surface, said frame including an upwardly extending column;

a carriage movably mounted to said column for up and down movement relative to said column;

a first transducer connectable to the power source and connected between said frame and said carriage to selectively, reciprocatingly move said carriage relative to said column; and means on said carriage for supporting and retaining the limb to carry the limb with said carriage during movement of said carriage to thereby stretch and strengthen the limb;

said first transducer including a rodless cylinder, said rodless cylinder comprising:

a rigid, elongated, hollow barrel of non-ferrous material connected between said frame and said carriage and having first and second ends, said barrel having a first fluid inlet port at said first end and a second fluid inlet port at said second end of said barrel with each of said ports being fluidically connectable to the source of pressurized fluid;

a piston member within said hollow barrel mounted for sliding movement between said first and second ends of said barrel in response to fluid movement into and out of said first and second inlet ports;

a follower member outside said barrel, closely adjacent thereto and mounted for movement along and parallel to said barrel;

one of said members including an element of ferrous material and the other of said members including a magnet so that said member with said magnet will magnetically attract and engage the remaining member to cause said follower member to move with said piston along said barrel; and said follower member being connected to said carriage so said carriage and follower member can disengage said core if excessive loading is applied to said carriage to break the magnetic attraction between said follower member and said piston member.

27. A human limb manipulation device connectable to a power source including a source of pressurized fluid and usable on a surface to move a human limb along a predetermined path to stretch and strengthen the limb comprising:

a rigid frame supportable on the surface;

a carriage movably mounted to said frame for back and forth movement relative to said frame;

a rodless cylinder comprising:

a rigid, elongated, hollow barrel of non-ferrous material connected between said frame and said carriage and having first and second ends, said barrel having a first fluid inlet port at said first end and a second fluid inlet port at said second end of said barrel with each of said ports being fluidically connectable to the source of pressurized fluid;

a piston member within said hollow barrel mounted for movement between said first and second ends of said barrel in response to fluid movement into and out of said first and second inlet ports;

a follower member outside said barrel closely adjacent thereto and mounted for movement along and parallel to said barrel;

one of said members including an element of ferrous material and the other of said members including a magnet so that said member with said magnet will engage the remaining member to cause magnetic attraction between said follower member and said piston member to cause said members to move together along said barrel;

said follower member being connected to said carriage so said carriage and follower member can disengage said piston member if excessive loading is applied to said carriage to break the magnetic attraction between said follower member and said piston member; and means on said carriage for supporting and retaining the limb to carry the limb with said carriage during movement of said carriage to thereby stretch and strengthen the limb.

28. The human limb manipulation device of claim 27 wherein said magnet is an electromagnet energizable from the power source.

29. The human limb manipulation device of claim 27 and further including a computer control system connectable to the power source and connected to said rodless cylinder to actuate said cylinder to repeatedly move said carriage back and forth to move the limb along the path.

30. A rodless cylinder usable with a source of pressurized fluid and an electrical power source and attachable between a base and a load to move the load along a path and disengage from the load when a predetermined opposition force is encountered comprising:

a rigid, elongated, hollow barrel of nonferrous material connectable to the base and having first and second ends, said barrel having a first fluid inlet port at said first end a second fluid inlet port at said second end of said barrel with each of said ports being selectively, fluidically connectable to the pressurized fluid;

a piston member within said hollow barrel and mounted for movement between said first and second ends of said barrel in response to fluid movement into and out of said first and second inlet ports, said piston member including an element formed of ferrous material;

a follower member outside said barrel, closely adjacent thereto and mounted for movement along and parallel to said barrel;

said follower member including an electromagnet closely confronting said barrel and connectable to the electrical power source for selective energization so that during energization said follower member will magnetically engage said piston member with a predetermined level of magnetic attraction to cause said follower member to lock onto and retain said piston member and move along said barrel with said piston member, and said follower member can disengage said piston member when the predetermined opposition force is applied to said follower member to break the magnetic attraction between said follower member and said piston member and also when said electromagnet is deenergized.

31. The rodless cylinder of claim 30 wherein said electromagnet is annular in configuration and slidably encircles said barrel to move therealong.

32. The rodless cylinder of claim 30 and further including a potentiometer electrically connected with said electromagnet to control the current magnitude through said electromagnet to thereby regulate the level of magnetic attraction and the force required to cause said follower member to separate from said piston member.

33. The rodless cylinder of claim 30 and further including a switch electrically connected with said electromagnet and said power source to interrupt current flow to said electromagnet to cause substantially immediate disengagement of said follower member from said piston member.

* * * * *